US006722904B2

(12) United States Patent
Linhart

(10) Patent No.: US 6,722,904 B2
(45) Date of Patent: Apr. 20, 2004

(54) VACUUM CLEANER HOSE WITH A CONNECTION SLEEVE

(75) Inventor: Georg Peter Linhart, Wohnsitz (DE)

(73) Assignee: Ruplast Kunststofftechnik GmbH (DE)

( * ) Notice: Subject to any disclaimer, the term of this patent is extended or adjusted under 35 U.S.C. 154(b) by 0 days.

(21) Appl. No.: 10/238,816

(22) Filed: Sep. 10, 2002

(65) Prior Publication Data

US 2003/0073335 A1 Apr. 17, 2003

(30) Foreign Application Priority Data

Sep. 10, 2001 (DE) ..... 201 14 935 U

(51) Int. Cl.[7] ..... H01R 4/60; H01B 7/24

(52) U.S. Cl. ..... 439/191; 439/195; 439/194; 174/47; 174/135; 174/82

(58) Field of Search ..... 174/47, 82, 138 F, 174/84 R, 84 S, 93, 135, 136, 65 R, 65 G, 152 R, 152 G, 153 G, 48; 439/450, 448, 191, 24; 15/377, 410; 285/7; 138/122, 133, 138, 155

(56) References Cited

U.S. PATENT DOCUMENTS 3,636,285 A * 1/1972 Wickham et al. ..... 200/51 R
4,064,355 A * 12/1977 Neroni et al. ..... 174/47
4,345,805 A * 8/1982 Finley et al. ..... 439/191
4,517,404 A * 5/1985 Hughes et al. ..... 174/47
4,711,974 A * 12/1987 Borsh ..... 174/65 R
6,015,298 A * 1/2000 Linhart ..... 439/24
6,087,595 A * 7/2000 Linhart ..... 174/136
6,311,730 B2 * 11/2001 Penza ..... 138/98
6,353,178 B1 * 3/2002 Linhart ..... 174/47
6,392,150 B2 * 5/2002 Linhart ..... 174/82
6,555,749 B1 * 4/2003 Pyron ..... 174/65 R

* cited by examiner

*Primary Examiner*—Dean Reichard
*Assistant Examiner*—Angel R. Estrada
(74) *Attorney, Agent, or Firm*—Reising, Ethington, Barnes, Kisselle, P.C.

(57) ABSTRACT

A vacuum cleaner hose with a connection sleeve includes a hose (1) having an inner wall, a protective envelope (2) for electrical conductors (3) attached at an inner wall of the hose (1), a rear connection part (4*a*) formed at a connection sleeve (4) and engaging partially into the hose (1), a receiver (4*b*) extending from the rearward end of the connection sleeve (4) and formed for an insertion of a coordinated end of the protective envelope (2), wherein an end of the receiver (4*b*) is disposed opposite to an end for insertion and is closed. The receiver (4*b*) is formed as a tube molded to the inner jacket face of the rear connection part (4). The tube exhibits a first recess (4*d*) directed rearwardly from the closed end of the tube.

7 Claims, 1 Drawing Sheet

VACUUM CLEANER HOSE WITH A CONNECTION SLEEVE

BACKGROUND OF THE INVENTION

1. Field of the Invention

The invention relates to a vacuum cleaner hose with a connection sleeve.

2. Brief Description of thee Background of the Invention Including Prior Art

A vacuum cleaner hose with a connection sleeve is already known. Here the receiver for the end of the protective envelope comprises a projection furnished in the rear connection part, wherein the projection starts from the flanks of a slot disposed in the wall of the projection. The conventional construction has proven advantageously. However the slot in the wall of the rear connection part is not completely satisfying, since the slot can interfere with the radial stiffness of the rear connection part. In case of a use of a hose and/or of the connection sleeve, a sealing failure can be generated between the hose and the part of the rear connection part engaging into the hose, wherein the sealing failure decreases the suction force in the hose.

SUMMARY OF THE INVENTION

1. Purposes of the Invention

It is an object of the invention to furnish a vacuum cleaner hose with a connection sleeve such that a sealing failure between the hose and the connection sleeve is avoided.

These and other objects and advantages of the present invention will become evident from the description which follows.

2. Brief Description of the Invention

The present invention provides that a stiffness of the rear connection part is accomplished by having the rear connection part of the connection sleeve circumferentially closed up to the recess for the leading out of the electrical conductors, whereby a sealing failure is avoided between the hose and the rear connection part of the connection sleeve.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing. An embodiment of the invention is schematically illustrated in the drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
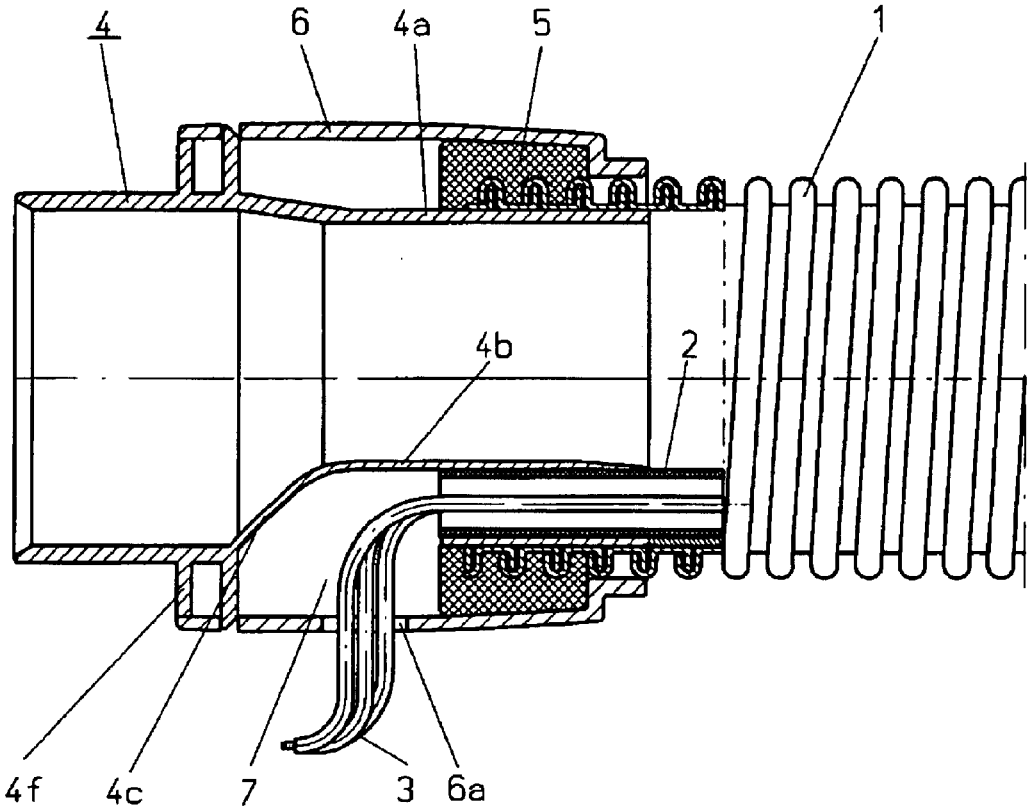
FIG. 1 a view of the vacuum cleaner hose with a connection sleeve, partially in a sectional view, FIG. 2 a connection sleeve in a perspective view.

The vacuum cleaner hose is designated with reference numeral 1 in the drawing, wherein the vacuum cleaner hose 1 is smooth in the inside and exhibits on the outside helically running wave valleys and wave mountains. A protective envelope 2 for electrical conductors 3 is attached at the inner wall of the hose 1.

A rear connection part 4*a* of a connection sleeve designated overall with reference numeral 4 engaging is in part into the hose 1 and exhibits a receiver 4*b* extending from the rearward end of the sleeve and formed for the insertion of this coordinated end protective envelope 2. The protective envelope 2 is covered in part by the receiver 4*b*. The outer diameter of the protective envelope 2 corresponds closely to the inner diameter of the receiver 4*b*. The end of the receiver 4*b* disposed opposite to the insertion end is closed by a wall 4*c* led to the connection sleeve 4.

The hose 1, the protective envelope 2 and the connection sleeve 4 are made out of thermoplastic material.

Figure 2:
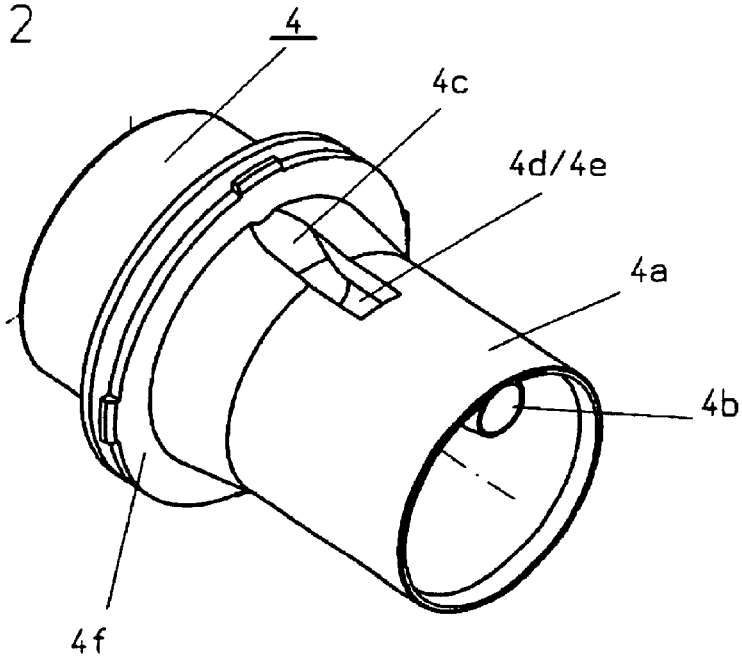

The receiver 4*b* is furnished as a tube formed at the inner jacket face of the rear connection part 4*a*, wherein the tube exhibits a rearwardly directed opening 4*d* as seen from the end of the tube closed by the wall 4*c*. The latter opening 4*d* transitions without step into an opening 4*e* in the jacket of the rear connection part 4 (FIG. 2) based on the molding process of the connection sleeve 4. The openings 4*d*/4*e* are disposed (FIG. 1) in a section of the connection sleeve 4 not covered by the hose 1. The openings 4*d*/4*e* serve for leading out of the electrical conductors 3 out of the rear connection part 4*a*.

The axial length of the opening is from about 0.15 to 0.3 times the axial length of the sleeve 4 and is preferably from about 0.2 to 0.25 times the axial length of the sleeve 4. The width of the opening corresponds to an angle measured from the sleeve axis of from about 20 to 50 degrees and preferably an angle of from about 25 to 40 degrees. The diameter of the receiver 4*b* is from about 0.15 to 0.5 times the diameter of the rear connection part 4*a* is preferably from about 0.26 to 0.3 times the diameter of the rear connection part 4*a*. The wall 4*c* can exhibit an angle of from about 30 to 60 degrees relative to the direction of the axis of the sleeve 4.

The jacket of the rear connection part 4*a* is closed circumferentially with the exception of the openings 4*d*/4*e*, whereby the radial stiffness of the rear connection part 4*a* becomes substantially increased.

The protective envelope, 2 is disengaged over part of the length of the protective envelope 2 from the inner wall of the hose 1 for the unimpeded insertion of the apex of the tubular receiver 4*b* formed in the rear connection part 4*a*.

The hose 1 carries an intermediate bush 5 screwed onto the hose 1 or molded at the hose 1, wherein the intermediate bush 5 is gripped around by an outer bush 6. The latter outer bush 6 is connected on the one hand disengageably with a sleeve collar 4*f* and on the other hand trips behind the intermediate bush 5. The outer bush 6 delimits radially a free space 7 (FIG. 1) extending between the collar of the sleeve 4*f* and the front end of the intermediate bush 5, wherein the electrical conductors 3 are bent over in the free space 7 to a passage recess 6*a* in the outer bush 6 furnished for the electrical conductors 3.

The outer diameter of the sleeve collar 4*f* can be from about 1.4 to 2 times the diameter of the rear connection part 4*a* and is preferably from about 1.5 to 1.7 times the diameter of the rear connection part 4*a*. The outer sleeve collar is disposed at the widest radial diameter of the wall 4*c*. The diameter of the outer bush can be from about 0.95 to 1.05 times the outer diameter of the sleeve collar 4*f*.

It will be understood that each of the elements described above, or two or more together, may also find a useful application in other types of cleaning system configurations and waste gas processing procedures differing from the types described above.

While the invention has been illustrated and described as embodied in the context of a VACUUM CLEANER HOSE WITH A CONNECTION SLEEVE, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vacuum cleaner hose with a connection sleeve comprising a) a protective envelope (2) for electrical conductors (3) is attached at an inner wall of the hose (1);

b) a rear connection part (4*a*) of the connection sleeve (4) engaging partially into the hose (1) exhibits a receiver (4*b*) extending from a rearward end of the sleeve and formed for the insertion of a coordinated end of the protective envelope (2);

c) a closed end of the receiver (4*b*) disposed opposite to an insertion end wherein d) the receiver (4*b*) is formed as a tube molded to an inner jacket face of the rear connection part (4*a*), wherein the tube exhibits a recess (4*d*) directed rearwardly from the closed end, wherein the recess (4*d*) transitions without step into a recess (4*e*) in the inner jacket face of the rear connection part (4*a*);

e) the recesses (4*d*/4*e*) transitioning into each other are disposed in a section of the rear connection part (4*a*) not covered by the hose (1);

f) the rear connection part (4*a*) is circumferentially closed with the exception of the recesses (4*d*/4*e*) disposed in the rear connection part (4*a*).

2. The vacuum cleaner hose according to claim 1 wherein the protective envelope (2) for the unimpeded insertion of the apex of the receiver (4*b*) containing the electrical conductors (3) is disengaged from the inner wall of the hose (1) over part of the length of the protective envelope (2).

3. The vacuum cleaner hose according to claim 1 wherein the hose (1) carries an intermediate bush (5) screwed onto the hose (1) or molded to the hose (1), wherein the intermediate bush (5) is surrounded by an outer bush (6), wherein the outer bush (6) is disengageably connected on the one hand to a collar (4*f*) of the sleeve and on the other hand the outer bush (6) grips behind the intermediate bush (5), and wherein the outer bush (6) delimits a free space extending between the collar (4*f*) of the sleeve and the front end of the intermediate bush (5) for the placement of the electrical conductors (3) to a passage recess (6*a*) in the outer bush (6).

4. A vacuum cleaner hose with a connection sleeve comprising a hose (1) having an inner wall;

a protective envelope (2) for electrical conductors (3) attached at an inner wall of the hose (1);

a connection sleeve (4);

a rear connection part (4*a*) formed at the connection sleeve (4) and engaging partially into the hose (1);

a receiver (4*b*) extending from the rear connection part (4*a*) of the connection sleeve (4) and formed for an insertion of a coordinated end of the protective envelope (2), wherein a closed end of the receiver (4*b*) is disposed opposite to an end for insertion;

wherein the receiver (4*b*) is formed as a tube molded to an inner jacket face of the rear connection part (4), wherein the tube exhibits a first recess (4*d*) directed rearwardly from the closed end of the tube, wherein the first recess (4*d*) transitions without step into a second recess (4*e*) in the jacket of the rear connection part (4*a*);

wherein the first recess (4*d*) and the second recess (4*e*) are disposed in a section of the rear connection part (4*a*) not covered by the hose (1);

wherein the rear connection part (4*a*) is circumferentially closed with the exception of the first recess (4*d*) and the second recess (4*e*) disposed in the rear connection part (4*a*).

5. The vacuum cleaner hose according to claim 4 wherein the protective envelope (2) is disengaged from the inner wall of the hose (1) over part of the length of the protective envelope (2) for an unimpeded insertion of an apex of the receiver (4*b*) containing the electrical conductors (3).

6. The vacuum cleaner hose according to claim 4 further comprising an intermediate bush (5), wherein the hose (1) carries the intermediate bush (5) screwed onto the hose (1);

an outer bush (6), wherein the intermediate bush (5) is surrounded by the outer bush (6), wherein the outer bush (6) is disengageably connected on the one hand to a collar (4*f*) of the sleeve and on the other hand the outer bush (6) grips behind the intermediate bush (5), and wherein the outer bush (6) delimits a free space extending between the collar (4*f*) of the sleeve and the front end of the intermediate bush (5) for the placement of the electrical conductors (3) to a passage recess (6*a*) in the outer bush (6).

7. The vacuum cleaner hose according to claim 4 further comprising an intermediate bush (5), wherein the hose (1) carries an intermediate bush (5) molded to the hose (1);

an outer bush (6), wherein the intermediate bush (5) is surrounded by an outer bush (6), wherein the outer bush (6) is disengageably connected on the one hand to a collar (4*f*) of the sleeve and on the other hand the outer bush (6) grips behind the intermediate bush (5), and wherein the outer bush (6) delimits a free space extending between the collar (4*f*) of the sleeve and the front end of the intermediate bush (5) for the placement of the electrical conductors (3) to a passage recess (6*a*) in the outer bush (6).

* * * * *

UNITED STATES PATENT AND TRADEMARK OFFICE

CERTIFICATE OF CORRECTION

PATENT NO. : 6,722,904 B2
DATED : April 20, 2004
INVENTOR(S) : Georg Peter Linhart It is certified that error appears in the above-identified patent and that said Letters Patent is hereby corrected as shown below:

Title page,
Item [73], Assignee, please delete "Ruplast Kunststofftechnik GmbH" and insert:
-- Truplast Kunststofftechnik GmbH --

Signed and Sealed this

Second Day of November, 2004

JON W. DUDAS
*Director of the United States Patent and Trademark Office*